US006796214B2

(12) United States Patent
Hausken et al.

(10) Patent No.: US 6,796,214 B2
(45) Date of Patent: Sep. 28, 2004

(54) FIREARM SILENCER

(75) Inventors: Hans Petter Hausken, Førland, Aksdal N-5570 (NO); Odd Helge Rosberg, Padlane 30, Aksdal N-5570 (NO); Bent Arild Dueland, Skjoldastraumen (NO)

(73) Assignees: Hans Petter Hausken, Aksdal (NO); Odd Helge Rosberg, Aksdal (NO)

( * ) Notice: Subject to any disclaimer, the term of this patent is extended or adjusted under 35 U.S.C. 154(b) by 78 days.

(21) Appl. No.: 10/203,995

(22) PCT Filed: Feb. 15, 2001

(86) PCT No.: PCT/NO01/00053

§ 371 (c)(1),
(2), (4) Date: Dec. 19, 2002

(87) PCT Pub. No.: WO01/61269

PCT Pub. Date: Aug. 23, 2001

(65) Prior Publication Data

US 2003/0145718 A1 Aug. 7, 2003

(30) Foreign Application Priority Data

Feb. 15, 2000 (NO) ..... 000755

(51) Int. Cl.[7] ..... F41F 17/12
(52) U.S. Cl. ..... 89/14.4; 89/14.2
(58) Field of Search ..... 89/14.4

(56) References Cited

U.S. PATENT DOCUMENTS

| | | | | | |
|---|---|---|---|---|---|
| 3,667,570 | A | * | 6/1972 | WerBell, III | 181/223 |
| 3,713,362 | A | * | 1/1973 | Charron | 89/14.4 |
| 3,748,956 | A | * | 7/1973 | Hubner | 89/14.4 |
| 3,786,895 | A | * | 1/1974 | Perrine | 181/223 |
| 4,530,417 | A | * | 7/1985 | Daniel | 181/223 |

FOREIGN PATENT DOCUMENTS

| | | | |
|---|---|---|---|
| DE | 562475 | | 10/1932 |
| DE | 1279508 | | 10/1968 |
| DE | 2127877 | | 12/1972 |
| DE | 0581974 | * | 4/1976 |
| EP | 0107273 | * | 5/1984 |
| EP | 107273 | | 5/1984 |
| EP | 166802 | | 1/1986 |
| FR | 0858032 | * | 11/1940 |
| GB | 299449 | | 1/1930 |
| GB | DT2448865 | * | 10/1946 |
| IT | 0401021 | * | 1/1943 |
| SE | 507569 | | 6/1998 |
| WO | WO8903958 | * | 5/1989 |

(List continued on next page.)

*Primary Examiner*—Michael J. Carone
*Assistant Examiner*—Troy Chambers
(74) *Attorney, Agent, or Firm*—Andrus, Sceales, Starke & Sawall, LLP

(57) ABSTRACT

According to the invention a silencer for a firearm is arranged so that emitted gas, caught from the muzzle of the firearm after a shot, can both be caught and flow rearwards in the silencer after having been caught. This is accomplished in the way that the silencer comprises several separate chambers (1–5) extending longitudinally in the silencer. When the silencer is fitted to the firearm, there will be at least one chamber (1, 2) on either side of the muzzle of the weapon. The emitted gas is caught by holes (6) formed in a boundary surface between the chambers (1, 3, 4) in front of the muzzle and a central bore (16) through the silencer. The holes (6) extend radially through this boundary surface towards the bore (16) and are placed in rows which are spaced so that the holes (6) of each row will merge on the inside of the boundary surface towards the bore (16). The portion of emitted gas caught in the first chamber (1) in front of the muzzle then flows to the chambers (2, 5) behind the muzzle through openings formed in a surface (8) between the two chambers (1, 2) on either side of the muzzle, or through openings formed in a surface (9) between the chambers (2, 5) behind the muzzle.

9 Claims, 4 Drawing Sheets

U.S. PATENT DOCUMENTS 4,576,083 A * 3/1986 Seberger, Jr. ..... 89/14.4
4,907,488 A * 3/1990 Seberger ..... 89/14.4
4,945,812 A 8/1990 Mazzanti
4,974,489 A * 12/1990 Fishbaugh ..... 89/14.4
5,136,923 A 8/1992 Walsh, Jr.
5,164,535 A * 11/1992 Leasure ..... 89/14.4
6,374,718 B1 * 4/2002 Rescigno et al. ..... 89/14.4
6,425,310 B1 * 7/2002 Champion ..... 89/14.3

* cited by examiner

FIREARM SILENCER

CROSS REFERENCE TO RELATED APPLICATION

The present application is the U.S. national stage application of International Application PCT/NO 01/00053, filed Feb. 15, 2001, which international application was published on Aug. 23, 2001 as International Publication WO 01/61269. The International Application claims priority of Norwegian Patent Application 20000755, filed Feb. 15, 2000.

BACKGROUND AND SUMMARY OF THE INVENTION

The present invention relates to a silencer for firearms, the silencer being arranged so that emitted gas, caught from the muzzle of the firearm after a shot, can flow rearwards in the silencer.

For the reduction of undesired drawbacks, both to the person who shoots and to the environment round the shooting site, in connection with noise from firearm shooting, a number of silencers are already available. Most of them work according to the principle that emitted gas should not flow freely from the muzzle of the weapon after the shot, but, on the other hand, be caught by the silencer. Thereby such catching of the emitted gas, and possibly further treatment of the caught, emitted gas in the silencer will reduce the noise effect of the firearm. Some of the previously known silencers are additionally constructed so that the recoil effect of the weapon is damped.

The effect in the reduction of noise and/or recoil can be improved if the silencer is constructed so that the emitted gas, which is caught, flows rearwards in the silencer. Examples of such silencers with rearward flow of caught, emitted gas are shown in U.S. Pat. Nos. 2,449,571, 1,207,264, 3,707,899 and 2,192,081. Defects of the known silencers are, however, partly that they have a disproportionately complex construction, which increases the manufacturing costs, partly that they are heavy, which undesirably increases the weight of the weapon, and partly that they undesirably increase the length of the weapon, as the major part of the silencer will be in front of the weapon muzzle, which makes the weapon unstable during shooting.

BRIEF DESCRIPTION OF THE INVENTION

These, and possibly other defects of the previously known silencers, are remedied by the present silencer, which is characterized, according to the independent claim 1, by two or more separate cambers being formed longitudinally in the silencer, the silencer being mounted so to the firearm that there will be at least one chamber on either side of the muzzle. Further the emitted gas is caught through holes formed in a boundary surface between the at least one chamber in front of the muzzle and a bore through the silencer, the holes extending radially through the boundary surface towards the bore, and being placed in circumferential rows spaced apart so that the holes in each row will merge on the inside of the boundary surface towards the bore. Then the portion of emitted gas caught in the first chamber in front of the muzzle flows rearwards to the at least one chamber behind the muzzle through openings formed in a surface between the two chambers on either side of the muzzle, or further rearwards to at least one further following chamber through openings formed in a surface between the first chamber and the first following chamber, possibly surfaces between such following chambers. Other advantageous features of the invention appear from the present dependent Claims and otherwise from the description.

By means of the present invention a silencer is thus provided, which efficiently reduces both noise and recoil from the firearm. Moreover, the present silencer has a very simple construction, which does not undesirably add weight nor length to the weapon. Moreover, the present silencer can be used on a number of different types of firearms without any degree of modification worth mentioning, and after obtaining it, the user can easily adapt the silencer to the weapon in question and the relevant application of the weapon.

BRIEF DESCRIPTION OF THE DRAWING

In the following the present invention will be described in further detail by means of an advantageous non-limiting embodiment which appears from the appended drawings, in which.

DETAILED DESCRIPTION OF THE INVENTION

As already mentioned, the silencer according to the present invention is arranged so that emitted gas from the muzzle of the firearm after a shot can both be caught and flow rearwards then to a portion thereof, after having been caught. According to the embodiment shown, the silencer is formed longitudinally with five separate chambers 1, 2, 3, 4, 5, and it is so fitted to the firearm that three of the chambers 1, 3, 4 for the catching of the emitted gas from a shot are in front of the muzzle 19 of the firearm.

Figure 6:
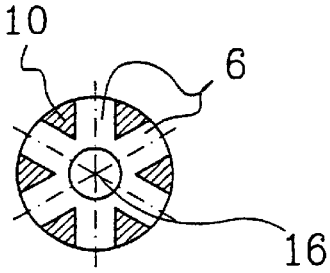
FIG. 6 is a cross-sectional view of the inner sleeve of the present silencer along the line B—B in FIG. 4.

The catching of emitted gas takes place through holes 6 formed in a boundary surface between the chambers 1, 3, 4 in front of the muzzle 19 and a central bore 16 through the silencer. These holes 6 extend radially through the boundary surface towards the bore 16, and are placed in circumferential rows of such spacing that the holes 6 of each row will merge on the inside of the boundary surface towards the bore 16, as shown in FIG. 6. The holes 6 of each row surrounding the catching chambers 1, 3, 4 in front of the muzzle 19 are offset and the mechanical strength of the silencer will thereby be reduced as little as possible. This particular arrangement of the holes 6 through the boundary surface towards the bore 16 is an essential factor for the silencer of the invention to exhibit such superior noise and recoil reducing effect.

Figure 5:
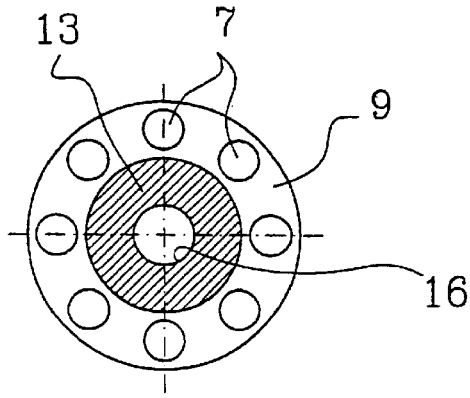
FIG. 5 is a cross-sectional view of the inner sleeve of the present silencer along the line A—A in FIG. 4.

A relatively large portion of the emitted gas is caught in the first chamber 1 in front of the muzzle 19. Then the portion of emitted gas caught in the first chamber 1 in front of the muzzle 19 flows rearwards to the chambers 2, 5 through openings 7, cf. FIG. 5, formed in a surface 8 between the two chambers 1, 2 on either side of the muzzle 19, or through corresponding openings 7 formed in a surface 9 between the first chamber 2 behind the muzzle 19 and a following chamber 5.

The chambers 1, 2, 3, 4, 5 are defined by one outer sleeve 12 and one inner sleeve 13 which extend longitudinally in the silencer, and a number of disc-shaped surfaces 8, 9, 10, 11 which extend between the outer and inner sleeves 13, 12. The Disc surfaces 8, 9, 10, 11 are suitably formed for the purpose, as integral parts of the inner sleeve 13. Further the outer sleeve 12 is formed so that it will bear sealingly on the free ends of the disc surfaces 8, 9, 10, 11 opposite the inner sleeve 13. As shown, the outer sleeve 12 is secured to the last disc surface 11 at the end of the silencer behind the muzzle, for example by a threaded connection 18.

Figure 1:
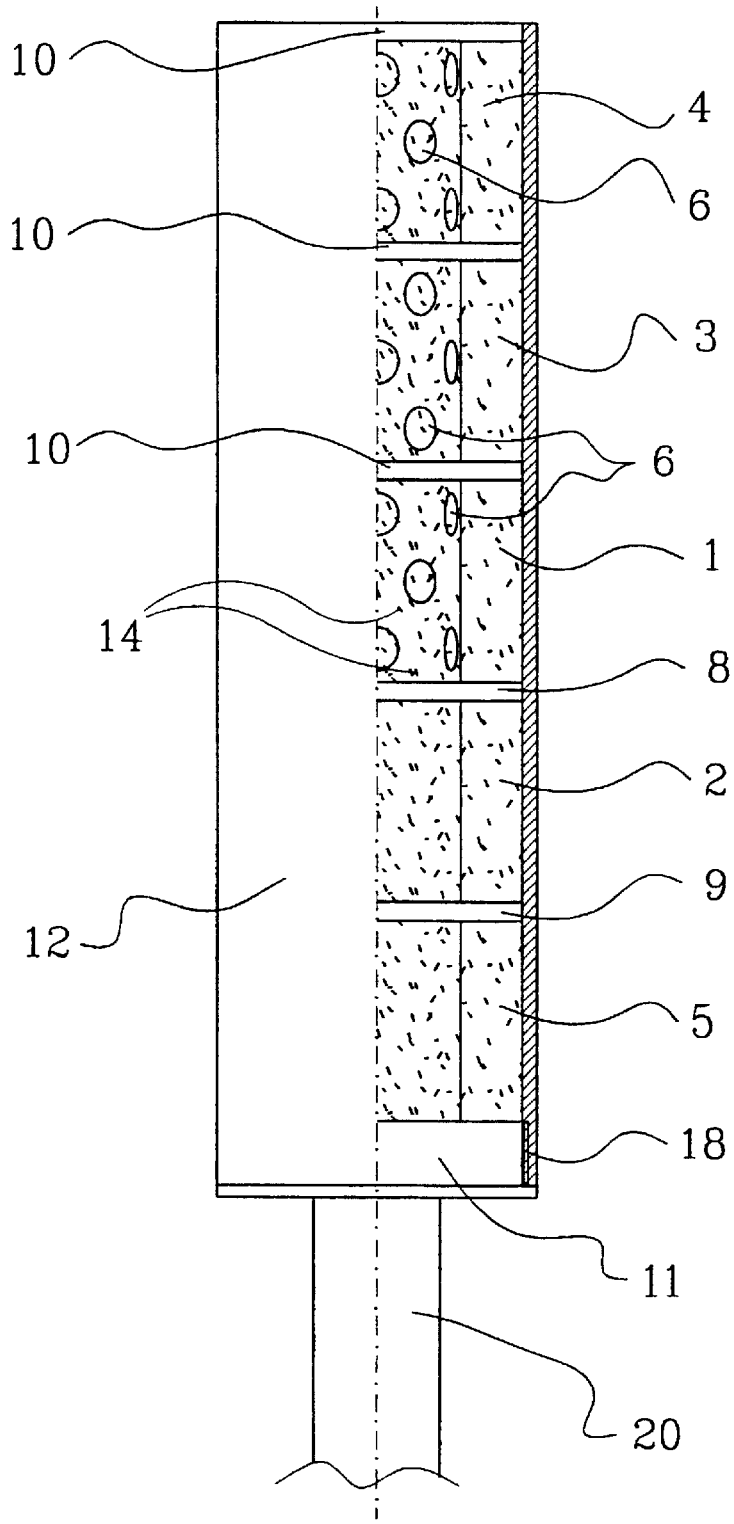
FIG. 1 shows a side view of the present silencer, which has five separate chambers filled with a sound-reducing material of aluminium chips, a longitudinal portion of an outer sleeve of the silencer being omitted, so that the internal configuration can partly be shown in further detail.
Figure 2:
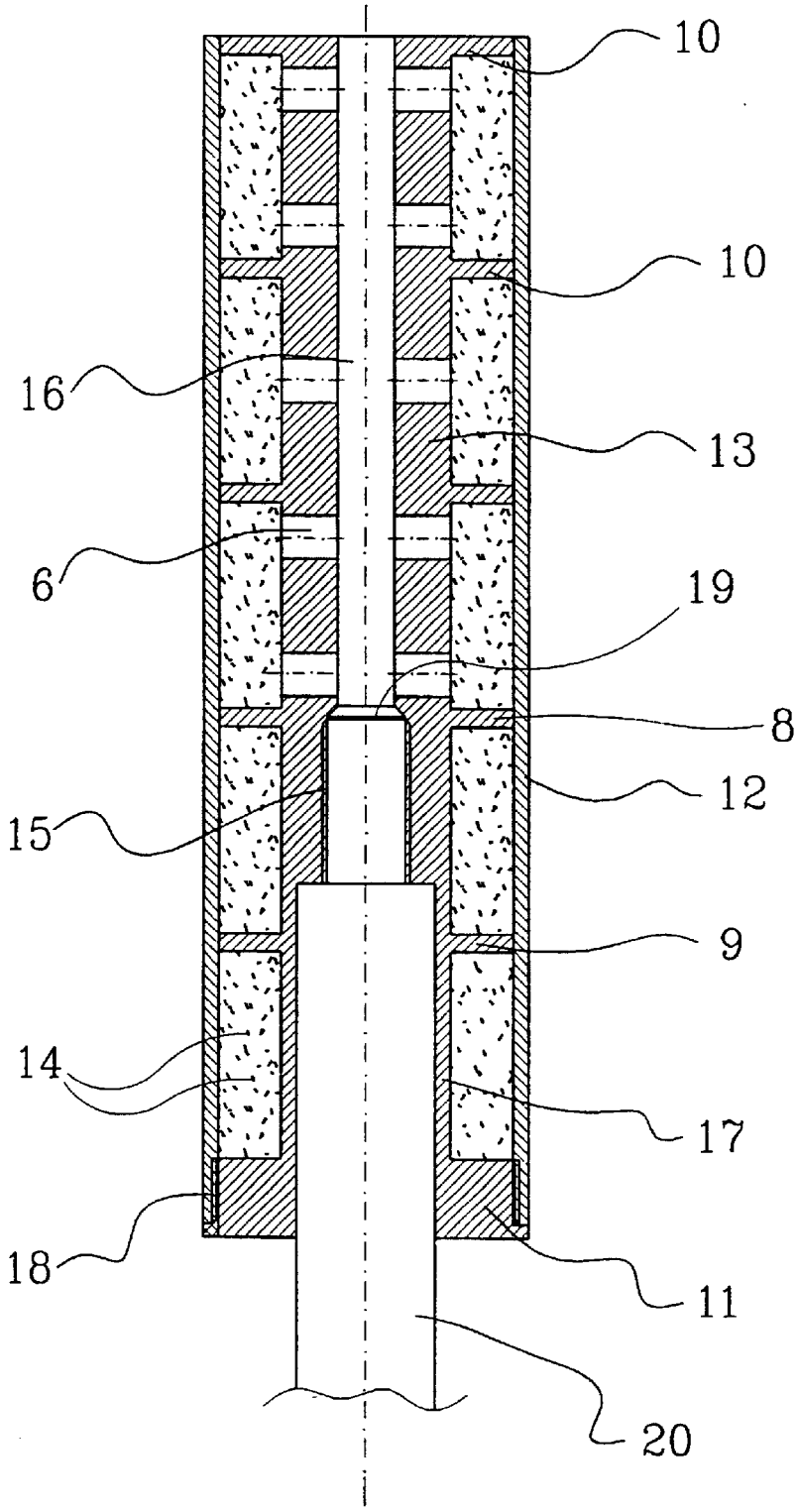
FIG. 2 shows a longitudinal cross-sectional view of the present silencer fitted at the muzzle of a firearm by means of a threaded connection formed internally on an inner sleeve of the silencer, the chambers being defined by disc-like surfaces extending between the outer sleeve and the inner sleeve, emitted gas from shots being caught through holes formed in the inner sleeve in front of the muzzle, the portion of emitted gas caught in the first chamber flowing rearwards to the chambers behind the muzzle through not shown openings formed in the surface between the two chambers at the front and rear of the muzzle, or the surface between the chambers behind the muzzle.
Figure 3:
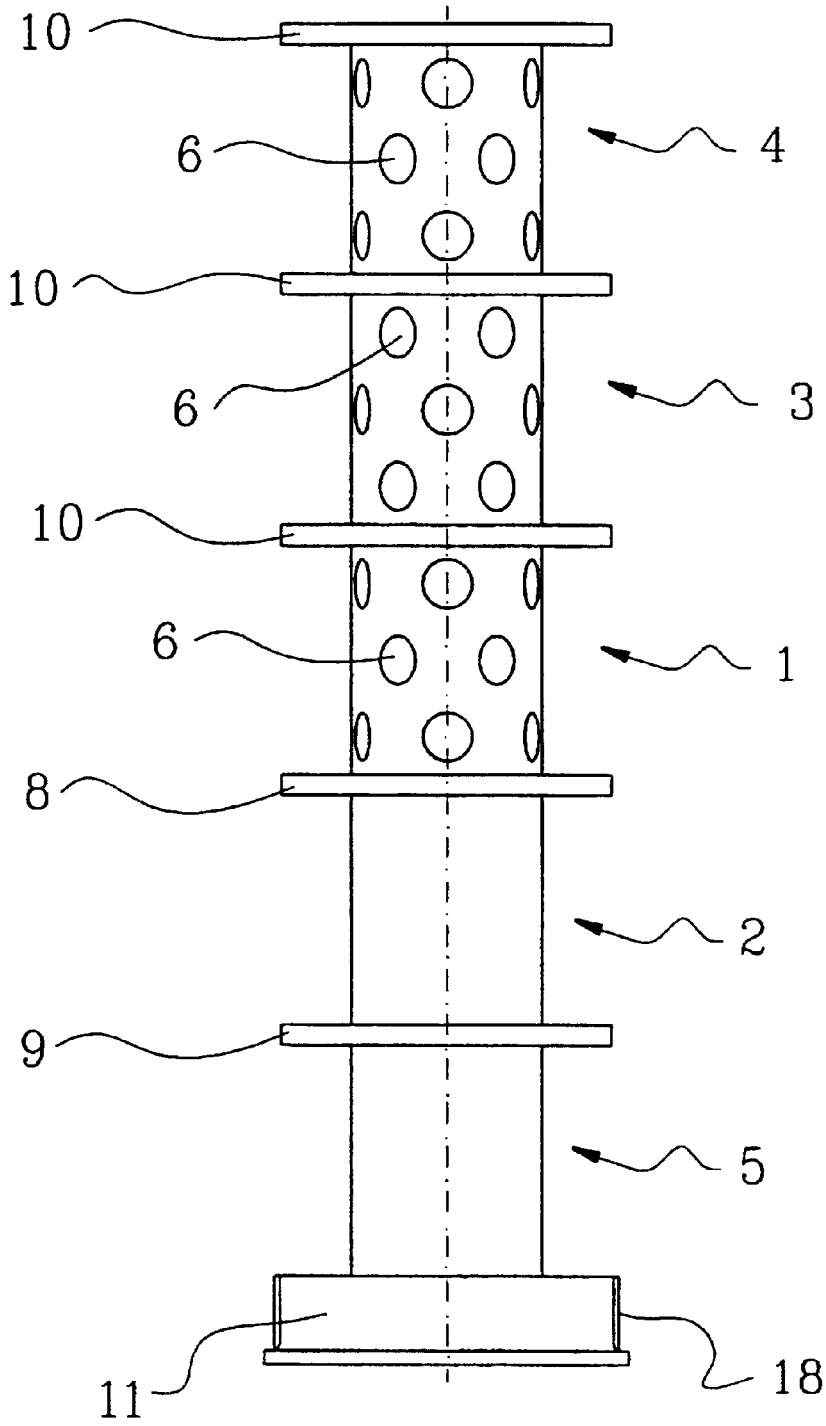
FIG. 3 is a side view of the inner sleeve of the present silencer.
Figure 4:
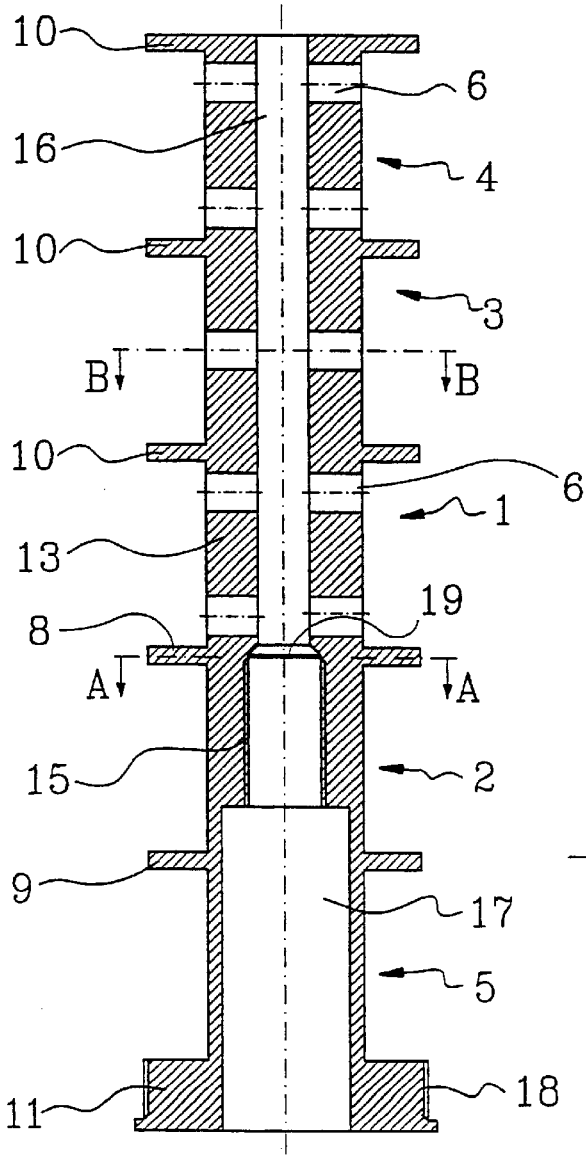
FIG. 4 is a longitudinal cross-sectional view of the inner sleeve of the present silencer.

The fitting of the silencer to the firearm may be accomplished by a means, e.g. a threaded connection 15, formed on the inside of the inner sleeve 13. As shown, for example in FIG. 2, a front end of the threaded connection 15 is near the disc surface 8 between the two chambers 1, 2 on either side of the muzzle 19 of the weapon. Further the threaded connection 15 for the fitting of the silencer is formed in a rear widened portion 17 of the bore 16, which extends through the inner sleeve 13. Accordingly, the firearm must be equipped with a corresponding threaded connection at the end of the muzzle 19. The bore diameter of the front portion of the bore 16, extending through the inner sleeve 13, essentially corresponds to the bore diameter of the barrel of the weapon.

The silencer according to the present invention is preferably made of aluminium, but of course another suitable material such as titanium, other metal or alloy, synthetic material etc. can be used for the production. Moreover, the effect of the silencer can be increased by filling all or some of the chambers 1, 2, 3, 4, 5 completely or partially with a silencing material 14, such as aluminium chips or other suitable silencing material. By such filling with sound-reducing material the outer periphery of the inner sleeve 13 between the disc surfaces 10 should be covered with fine-meshed netting, e.g. of stainless steel, not shown, so that the sound-reducing material 14 cannot enter the bore 16 through the holes 6 of the inner sleeve 13.

With the present configuration, at least one of the chambers 3, 4 located at the end of the silencer in front of the muzzle, can easily be removed from the silencer, so that the effect of the silencer can be optimized relative to the firearm in question and the use thereof. This can be accomplished in the way that e.g. the front chamber 4 is sawn off or removed in another suitable manner, immediately in front of the surface 10 between the two chambers 3, 4 in front of the muzzle 19.

In the embodiment shown the silencer has five separate chambers, and it is formed so that three chambers will be in front of the muzzle 19 of the firearm 20. However, this does not to prevent the number of chambers in the silencer from being changed, whenever required, compared to the ones shown, e.g. increased to six or reduced to four. Also, it is obvious that the number of chambers at the front and rear of the muzzle can be arranged in another manner than the one shown, e.g. with two chambers at the front and three chambers at the rear of the muzzle, or if the number is increased to six, with e.g. three chambers on either side of the muzzle 19. Moreover, depending on which firearm the silencer is to be adapted to, the length of each chamber, the number of holes for catching emitted gas and the distance between the inner and outer sleeves, among other things, may be changed.

The present silencer is particularly suitable for use during hunting and not least at shooting ranges, such as in huntsman's tests, shooting competitions and similar. For the Defence the silencer could with advantage replace exiting recoil dampers for the AG3. Of other relevant applications, brief mention can be made of use on machine guns, small cannons, small-bore weapons, pistols and shotguns.

What is claimed is:

1. A silencer for a firearm comprising two or more separate chambers (1, 2, 3, 4, 5) formed longitudinally in the silencer, the chambers (1, 2, 3, 4, 5) being defined by an outer sleeve (12) and an inner sleeve (13) which extend longitudinally in the silencer, and a number of disc-shaped surfaces (8, 9, 10, 11) which extend between the outer and inner sleeves (12, 13), a number of holes (6) formed in a boundary surface between at least one of the chambers (1, 3, 4) and a central bore (16) through the silencer, thereby allowing, after a shot, the gas emitted from the muzzle (19) of the firearm to flow into the at least one chamber (1, 3, 4), the holes (6) extending radially through the boundary surface towards the central bore (16) and the holes (6) of one row being offset relative to the holes (6) of an adjacent row, and a threaded connection (15) formed on the inside of the inner sleeve (13) for fitting the silencer to the firearm (20), at least one of the chambers (1), when the silencer is fitted to the firearm, being positioned in front of the muzzle and at least another of the chambers (2, 5) being positioned behind the muzzle (19), the at least another chamber (2, 5) behind the muzzle (19) being provided with openings (7) formed in a surface (8) between the chamber (1) in front of the muzzle and the chamber (2) behind the muzzle (19), thereby allowing the emitted gas received by the chamber (1) in front of the muzzle (19) to flow rearwards into the chamber (2) behind the muzzle.

2. A silencer according to preceding claim 1, characterized in that the holes (6) of each row merge on the inside of the boundary surface towards the central bore (16).

3. A silencer according to claim 1, characterized in that the disc-shaped surfaces (8, 9, 10, 11) are formed as integral parts of the inner sleeve (13).

4. A silencer according to claim 1, characterized in that the outer sleeve (12) bears sealingly on the peripheries of the disc-shaped surfaces (8, 9, 10), the outer sleeve (12) being secured to the periphery of the last disc-shaped surface (11) behind the muzzle.

5. A silencer according to claim 1, characterized in that the silencer is provided with five separate chambers (1, 2, 3, 4, 5), three of the chambers (1, 3, 4) being situated in front of the muzzle.

6. A silencer according to claim 1, characterized in that the separate chambers (1, 2, 3, 4, 5) are filled with a sound-reducing material (14), the outer surface of the inner sleeve (13) between the disc-shaped surfaces (10) being covered with a fine-meshed netting.

7. A silencer according to claim 1, characterized in that at least one of the chambers (3, 4) which is situated in front of the muzzle (19) when the silencer is fitted to the firearm, can be removed from the silencer.

8. A silencer according to claim 2, characterized in that the disc-shaped surfaces (8, 9, 10, 11) are formed as integral parts of the inner sleeve (13).

9. A silencer according to claim 1 characterized in that the silencer has at least one further chamber (5) behind the muzzle and the emitted gas flows rearward to said at least one further chamber through openings (7) formed in a surface (9) between said at least other chamber (2) positioned behind the muzzle and said at least one further chamber (5).

* * * * *